US005586763A

United States Patent [19]

De Bono et al.

[11] Patent Number: 5,586,763

[45] Date of Patent: Dec. 24, 1996

[54] SIAMESE CASE FOR STORING AND PLAYING TWO GAMES

[76] Inventors: Edward De Bono, L2 Albany Piccadilly, London, W1V 9RR, England; Maurice S. Kanbar, 2140 Pacific Ave. Apt. #5, San Francisco, Calif. 94115

[21] Appl. No.: 529,720

[22] Filed: Sep. 18, 1995

[51] Int. Cl.[6] ..... A63F 3/00

[52] U.S. Cl. ..... 273/285; 206/315.1

[58] Field of Search ..... 273/236, 285, 273/287; 206/315.1

[56] References Cited

U.S. PATENT DOCUMENTS

| | | | |
|---|---|---|---|
| 1,430,778 | 10/1922 | Williams | 273/285 |
| 1,549,610 | 8/1925 | Riesz | 273/285 |
| 1,553,655 | 9/1925 | Wadel | 273/285 |
| 4,513,974 | 4/1985 | Lin | 273/285 X |
| 4,875,688 | 10/1989 | Whaley | 273/285 |
| 5,190,295 | 3/1993 | Togni | 273/285 |
| 5,269,524 | 12/1993 | Womack | 273/285 X |
| 5,456,474 | 10/1995 | Geshkewich | 273/285 X |
| 5,478,085 | 12/1995 | Canner et al. | 273/285 X |
| 5,490,675 | 2/1996 | Persidsky et al. | 273/285 X |

FOREIGN PATENT DOCUMENTS

| | | | |
|---|---|---|---|
| 9212771 | 8/1992 | WIPO | 273/285 |

*Primary Examiner*—William E. Stoll
*Attorney, Agent, or Firm*—Michael Ebert

[57] ABSTRACT

A portable Siamese case for storing and playing two games, each having a play board and playing pieces movable thereon. The case is provided with a central section formed by a pair of open boxes in back-to-back relation on a common base in each of which is nested the playing board of a respective game and the play pieces therefor. Also included is a complementary pair of wing sections formed by covers hinged to opposite sides of the base. When either cover is folded over its related box, the closed box is then in a storage mode, and when the cover is unfolded to expose the box and its contents, the box is then in a playing mode.

7 Claims, 2 Drawing Sheets

SIAMESE CASE FOR STORING AND PLAYING TWO GAMES

BACKGROUND OF INVENTION

1. Field of Invention

This invention relates generally to cases for packaging games which make use of a playing board and play pieces movable thereon, and more particularly to a Siamese case for storing two different games, either one of which may be played without removing the game board from the case.

2. Status of Prior Art

Many games for two players such as chess, go and checkers make use of a playing board on which play pieces are movable. Such games are relatively complex and require a large playing board and a large number of play pieces. In order to provide the simplest possible game that could still be played with a high degree of skill, the De Bono U.S. Pat. No. 3,655,555 discloses a so-called L-Game for two players making use of a small playing board divided into sixteen squares.

In the L-Game, each player is provided with an L-shaped piece which overlies four squares. In addition there are two neutral pieces which can be moved by either player. Each neutral piece occupies only one square.

In the course of play, each player must move his L-piece to a new position and to this end, he may pick up his L-piece and turn it around or otherwise manipulate the piece and then put it back on the board at a new position to occupy a different set of four squares. After an L-piece has been moved to a new position, a player may, if he so wishes, then move either neutral piece to any unoccupied square on the board.

Before a neutral piece is touched, the L-piece must always be moved. The objective of an L-Game is to force an opponent into a position from which he cannot move. The game is won when the opponent cannot change the position of his L-piece.

A game for two players in a so-called Three Spot Game. This game makes use of three playing pieces and a board whose face presents an array of nine like squares, a scoring spot being contained in each of the three squares at one end of the array, the other six squares being blank. The three playing pieces are each in the form of a rectangular chip having a size corresponding to that of a pair of adjacent squares, so that in the course of play, each piece can be placed on the board to occupy any pair of adjacent square in the array in the X or Y direction. One piece is white and serves as a neutral piece, while the other two pieces have different colors, each player selecting for play a respective colored piece. A more detailed description of the game is found in the pending patent application of De Bono Ser. No. 08/513,050, filed Aug. 9, 1995, entiled "THREE SPOT GAME".

The concern of the present invention is with a case for storing two games, one of which may be a Three Spot Game and the other an L-Game. Since it is not concerned with the rules for playing these particular games, these rules will not be detailed herein.

The advantage of an L-Game and of a Three Spot Game, both of which make use of a small playing board and just a few play pieces, is that the game may be played almost anywhere under conditions which militate against playing a more complex game such as chess, which requires a large board and many more play pieces. Thus one may play an L-Game or a Three Spot Game on a plane or train where the two players occupy adjacent seats, or on a park bench or beach.

But if these games are to be played away from home, it is desirable that the games be packaged in a portable case, and this may give rise to other problems. Thus if the game is kept in the box in which it is sold and this box is used as a transport carrier, then to play the game one must remove the board and play pieces from the box and find a place to lay down the board and these pieces. Such a place may not be readily available. And when the playing board and pieces are removed from the box in which they are stored, one then runs the risk of losing or misplacing one or more of the play pieces, or even the board itself.

SUMMARY OF INVENTION

In view of the foregoing, the main object of this invention is to provide a portable Siamese case for storing and playing two games, each having a playing board and play pieces.

More particularly, an object of this invention is to provide a Siamese case of the above type in which one game is an L-Game and the other a Three Spot game, both having a playing board of the same dimensions.

A significant advantage of a case in accordance with the invention is that in a storage mode both games are safely encased, while in a playing mode one may play either game without removing the board from the case.

Also an object of this invention is to provide a highly compact Siamese case having a pair of sections either section of which is simple to open.

Briefly stated, these objects are attained by a portable Siamese case for storing and playing two games, each having a playing board and play pieces movable, thereon. The case is provided with a central section formed by a pair of open boxes in back-to-back relation on a common base in each of which is nested the playing board of a respective game and the play pieces therefor. Also included is a complementary pair of wing sections formed by covers hinged to opposite sides of the base. When either cover is folded over its related box, the closed box is then in a storage mode, and when the cover is unfolded to expose the box and its contents, the box is then in a playing mode.

BRIEF DESCRIPTION OF DRAWING

For a better understanding of the invention, as well as other objects and features thereof, reference is made to the detailed description thereof to be read in conjunction with the annexed drawing wherein.

DESCRIPTION OF INVENTION

A portable Siamese case in accordance with the invention is adapted to store two games having playing boards of like dimensions. While the case will be described in connection with an L-Game as shown in FIG. 1 and a Three Spot Game as shown in FIG. 2, it is to be understood that the case is usable with other games and can be dimensioned to accommodate these games.

Figure 1:
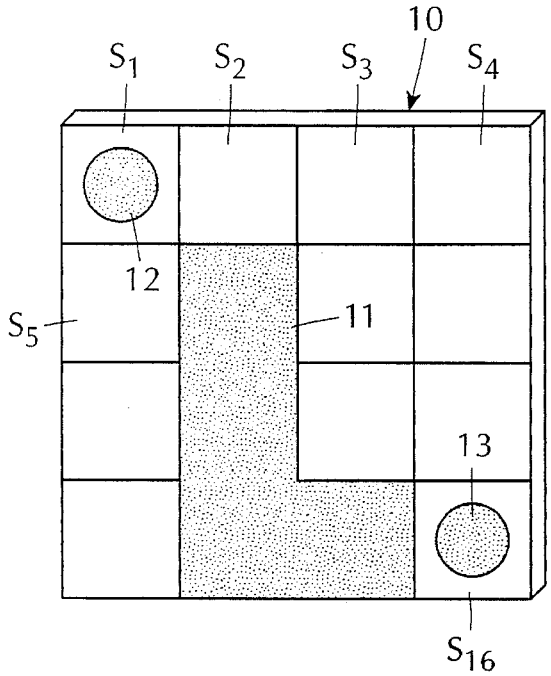
FIG. 1 shows an L-Game board and playing pieces movable thereon.
Figure 3:
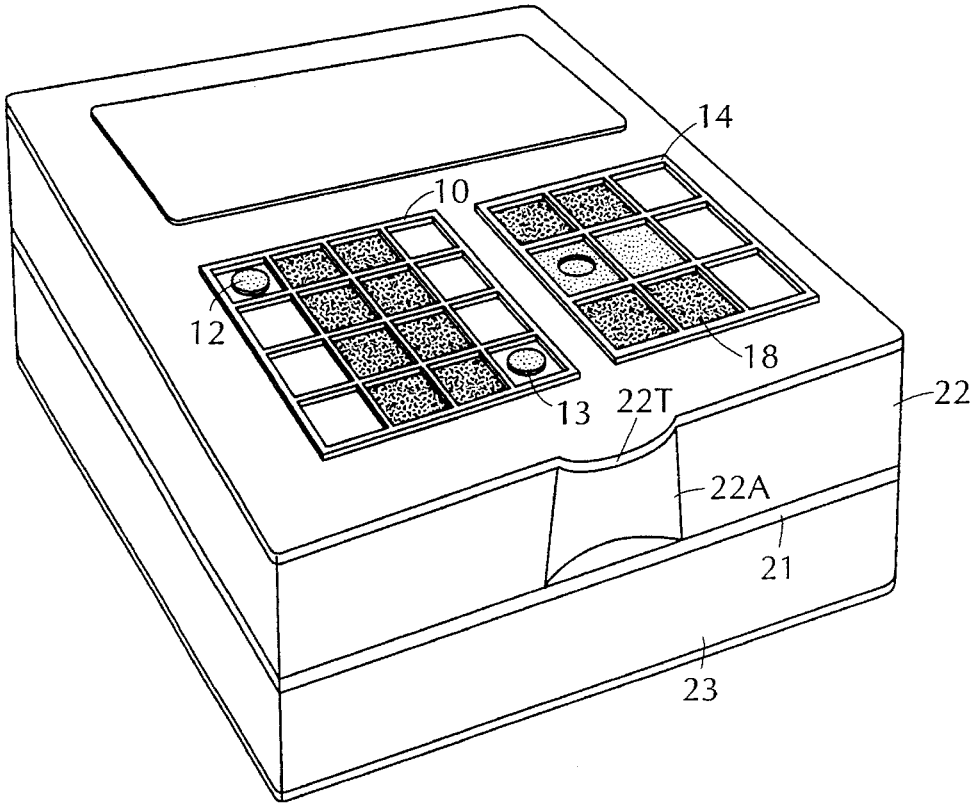
FIG. 3 is a perspective view of a Siamese case for two games in accordance with the invention, the case on its cover illustrating the two games.

The L-Game illustrated in FIGS. 1 and 3 makes use of a small playing board 10 divided into sixteen like squares $S_1$ to $S_6$. The play pieces in an L-Game consist of two L-shaped pieces only one of which, piece 11, is shown, in FIG. 1 whose size is such that the L-piece occupies four squares on the board 10. In addition two round neutral pieces 12 and 13 are provided, each occupying one square on the board. The manner in which the L-Game is played is not of present concern.

Figure 2:
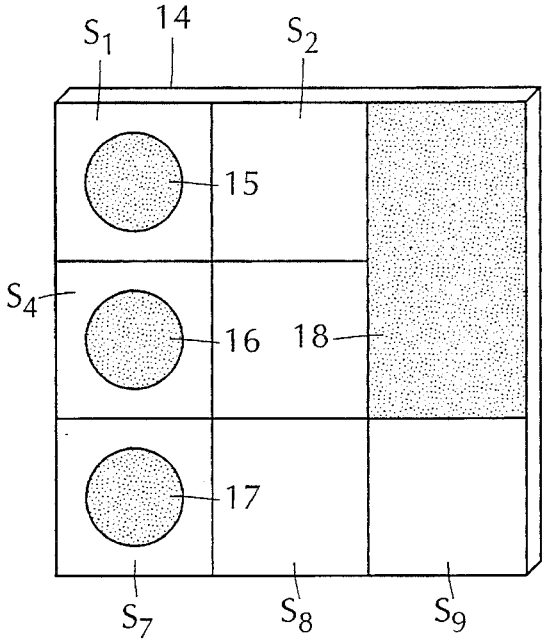
FIG. 2 shows a Three Spot Game and one of the three playing pieces movable thereon.

As shown in FIGS. 2 and 3, the Three Spot Game uses a play board 14 having the same dimensions as play board 14 for the L-Game but is divided into an array of nine like squares $S_1$, $S_4$ and $S_7$, at one end of the array are scoring spots 15, 16 and 17 respectively. Spots 15, 16 and 17 have different colors (i.e. white, red and blue). Three playing pieces are provided each in the forms of a rectangular chip having a size corresponding to that of a pair of adjacent squares, only one chip 18 being shown in FIG. 2. The rules of this game are not of present concern.

Figure 4:
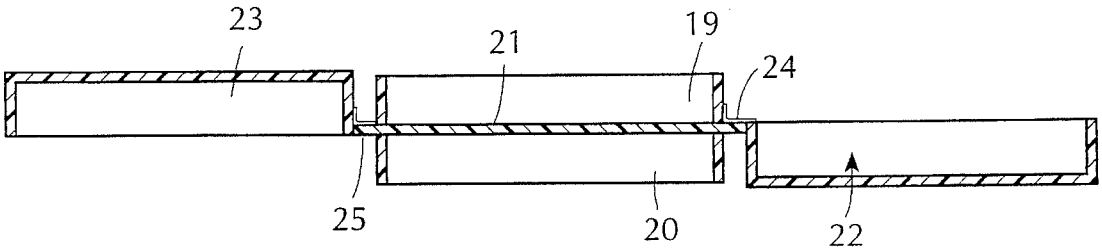
FIG. 4 shows the wing sections of the Siamese case out-stretched from the central section of the case.

A Siamese case in accordance with the invention is adapted to store both games, to provide a compact carrier therefor, and also to make it possible to play either game without removing it from the case. The case, as shown in FIGS. 3 and 4, comprises a central section formed by a pair of open boxes 19 and 20 in back-to-back relation on a common base 21 forming the bottom of each box. The square dimensions of the boxes are substantially the same as those of the playing boards so that playing board 10 may be nested in one box and playing board 14 in the other box.

Also provided are a complementary pair of wing sections formed by flanged covers 22 and 23. Cover 22 is hinged to one side of base 21 of the central section by a fabric tape 24 so that when cover 22 is folded over as shown in FIG. 3, it then closes box 19 in which one of the games is housed. Cover 23 which is hinged by a tape 25 to the other side of base 21 when folded over then closes box 20 containing the other game. Each cover, such as cover 22, is provided as shown in FIG. 3 with a finger rest extension 22T below which is an arcuate indentation 22A to facilitate raising the cover.

Figure 5:
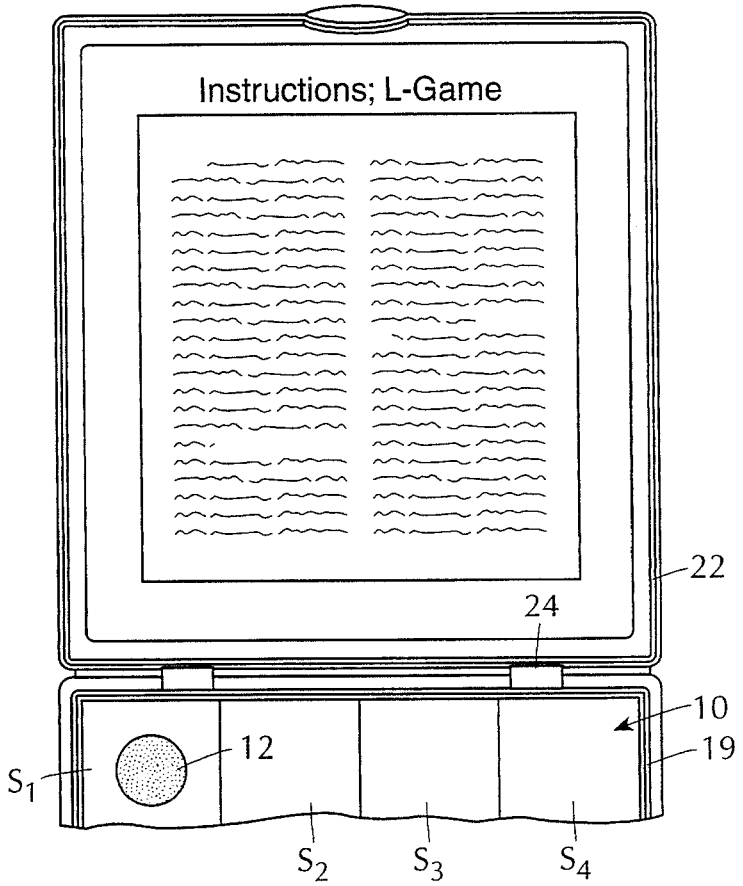
FIG. 5 is a plan view of one of the open boxes of case and the complementary flanged cover hinged thereto.

FIG. 5 illustrates box 19 in a playing mode in which cover 22 is folded out to expose the interior of the box in which playing board 10 for the L-Game is nested. It will be seen that instructions for playing the L-Game are printed on the inner wall of cover 22 so that the players can, if necessary, consult these instructions.

When box 19 is in its playing mode, then play pieces which are not on the play board are placed in the flanged cover 22 so that at no time are the pieces removed from the case, thereby reducing the likelihood that the pieces will be lost or misplaced. When the game is over, all pieces are placed in box 19 and the box is then closed by cover 22 so that now it is in the storage mode. If one now wishes to play the Three Spot game, one simply turns over the case and unfolds cover 23 to expose this game in box 20.

Thus the Siamese case produces a highly compact carrier for two games which can be played almost anywhere. It is not necessary to spread out the game on an exterior playing surface, for the game may be played without removing it from the case. However, if one wishes to do so, one can also remove the game from the case.

Figure 6:
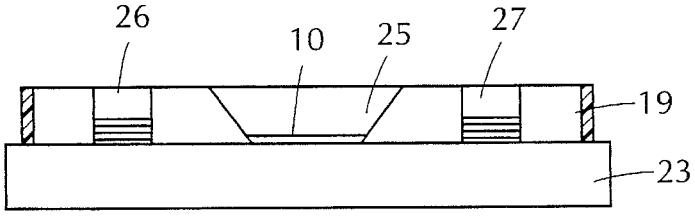
FIG. 6 illustrates the front end of one of the open boxes.

The front side wall of each box, such as box 19 as shown in FIG. 6, is provided with a center notch 25 to make it easy to remove playboard 10 seated on the base of the box. The side wall is also provided on either side of notch 25 with a wedge (26 and 27) which is frictonally engaged by corresponding wedges on the front flange of cover 22 which folds over box 19. These wedges hold the cover closed without the need for a latch or other locking means for the purpose.

While there has been shown a preferred embodiment of the invention, it is to be understood that many changes and modifications may be made therein without departing from the essential spirit of the invention.

We claim:

1. A Siamese case and two games stored in the case, each game having a play board and playing pieces movable on the board, said case comprising:

A. a central section formed by a pair of open boxes in back-to-back relation, each box being adapted to nest the board of a respective game and to accommodate its play pieces; and B. a complementary pair of wing sections, each formed by a cover hinged to a respective side of the central section whereby when the cover is folded over its related box, the closed box is then in a storage mode, and when the cover is folded out to expose the open box and its contents, the box is then in a playing mode.

2. A case as set forth in claim 1, in which each board is divided into squares.

3. A case as set forth in claim 1, in which the open boxes have a common base, and the covers are hinged to opposite sides of the base.

4. A case as set forth in claim 1, in which each cover is flanged so that when folded over the related box the flanges then conform to the sides of the box.

5. A case as set forth in claim 1, in which each cover is provided with a finger rest projection.

6. A case as set forth in claim 1 in which one of the games is an L-game which includes a playing board of predetermined size.

7. A case as set forth in claim 1, in which one of the games is a Three Spot game.

* * * * *